US005359343A

United States Patent [19]

Nakamura

[11] Patent Number: 5,359,343

[45] Date of Patent: Oct. 25, 1994

[54] DYNAMIC ADDRESSING DISPLAY DEVICE AND DISPLAY SYSTEM THEREWITH

[75] Inventor: Tadashi Nakamura, Tokyo, Japan

[73] Assignee: NEC Corporation, Tokyo, Japan

[21] Appl. No.: 9,893

[22] Filed: Jan. 27, 1993

[30] Foreign Application Priority Data

Jan. 27, 1992 [JP] Japan ..... 4-011524

[51] Int. Cl.[5] ..... G09G 3/36

[52] U.S. Cl. ..... 345/100; 345/98; 345/197; 377/54

[58] Field of Search ..... 340/784, 802, 811, 731, 340/730, 728, 800; 307/602; 377/54, 52, 64, 110; 345/98, 99, 100, 94, 197

[56] References Cited

U.S. PATENT DOCUMENTS 4,746,915 5/1988 Sekiya ..... 340/784

OTHER PUBLICATIONS

Mims, F. Engineer's Notebook, pp. 32, 112, Radio Shack, 1980.

*Primary Examiner*—Alvin E. Oberley
*Assistant Examiner*—Aaron Banerjee

[57] ABSTRACT

A dynamic addressing display device includes a display panel and generates a number of dot data signals and data clock signals equal to the number of picture elements per row required to display one character on the display panel. It is therefore not necessary to generate extra dot data signals or data clock signals representing additional data driver bits greater than the number of picture elements per row required to display one character on the display panel. A data driver is coupled to the display panel for driving a plurality of data electrodes of the display panel. The number of data clock signals is counted by a data clock counter. When the number of clock signals counted equals the number of picture elements per row required to display one character on the display panel the data clock signals are modulated by a data clock adder to shift the clock signals an amount of bits equal to the additional number of outputs of the data driver. The resultant clock signals are sent to a shift register. Then, the data stored in the shift register is shifted in sequence with the modulated clock signals to drive the data electrodes. Thus all the data signals generated to display one character on a display panel are used.

12 Claims, 5 Drawing Sheets

DYNAMIC ADDRESSING DISPLAY DEVICE AND DISPLAY SYSTEM THEREWITH

BACKGROUND OF THE INVENTION

1. Field of the Invention

This invention relates to a dynamic addressing display device and a dynamic addressing display system using the devices.

2. Description of Related Art

Generally, a dynamic addressing system which drives a liquid crystal display panel in a time division manner is used for a large-capacity liquid crystal display (LCD). In this addressing system, the display panel contains scan electrodes and data electrodes which are disposed like a matrix; a voltage is applied in sequence to the scan electrodes in a time division manner for scanning the scan electrodes and in synchronization with the scanning, a voltage is selectively applied to the data electrodes in response to the display contents at the time. This system displays the picture elements formed at the intersections of the scan electrodes and data electrodes as desired.

Recently, integration of drive circuits in a dynamic addressing LCD device has been advanced to one semiconductor chip on which a large number of drive circuits are mounted, and the numbers of drive circuits have been standardized for a decreased cost. However, the standardized numbers of drive circuits often mismatch the display capacity determined by market's needs because the specifications required for LCD devices vary from one application to another.

FIG. 1 shows an example of an LCD device where the number of output circuits of a data electrode driver does not match the number of picture elements or dots per row required to display one character on a display panel. The device shown in FIG. 1 comprises a display panel 13 containing scan electrodes (not shown) and data electrodes (not shown) which are disposed like a matrix, a scanning driver block 10 for driving the scan electrodes and a data driver block 6 for driving the data electrodes. The number of picture elements or dots required to display one character on the display panel 13 is 24×24 (length×breadth), while a data driver 9 in the data driver block 6 has 32 output circuits, the number of which is greater by eight than the number of picture elements per row required to display one character on the panel 13. A scanning driver 12 in the scanning driver block 10 has 24 output circuits, the number of which matches the number of picture elements per row required to display one character on the panel 13.

The scanning driver block 10 comprises a shift register 11 and a driver 12. A scanning data signal and a scanning clock signal are fed through lines 4 and 5 respectively into the shift register 11. When the clock signal is fed into the shift register 11, the scanning data stored in the shift register 11 is sent to the driver 12 in parallel through 24 output circuits 11*a*. The driver 12 is responsive to the received scanning data for applying voltage in parallel through 24 output circuits 12*a* to turn on, for example, the first scan electrode. When a new clock signal is fed into the shift register 11, the scanning data signal in the shift register 11 is shifted one step and the scanning data at the time is sent to the driver 12 in parallel. In response to the received scanning data, the driver 12 turns on, for example, the second scan electrode.

Likewise, when 24 clock signals equal to the number of the scan electrodes are fed into the shift register 11, 24 scan electrodes are turned on in sequence and one scan terminates. This operation sequence is repeated on a predetermined cycle for scanning the scan electrodes.

The data driver block 6 comprises a shift register 7, a latch 8 and a driver 9. A data clock signal and a dot data signal are sent to the shift register 7 through lines 1 and 3 respectively. A latch signal is sent to the latch 8 through a line 2.

In response to the data clock signals, desired dot data is sent to the shift register 7 in sequence for storage. When as many dot data pieces as 32 dots of the display panel 13 have been sent to the shift register 7, the dot data pieces are sent to the latch 8 in parallel through output circuits 7*a* and 7*b* in synchronization with the above-mentioned scanning by the latch signal. When the dot data pieces are sent to the latch 8, dot data on a new cycle is sent to the shift register 7 for storage.

When the dot data pieces are sent to the latch 8, immediately they are sent out from the latch 8 to the driver 9 in parallel through output circuits 8*a* and 8*b*. When receiving the dot data pieces, the driver 9 sends them to the data electrodes in parallel through output circuits 9*a* and 9*b* to drive the data electrodes, so that information on the cycle is displayed on the display panel 13. This operation sequence is repeated to display desired information on the display panel 13.

Although the necessary numbers of the dot data signals and the data clock signals for the LCD device are each 24 which equals the number of the data electrodes of the display panel 13, 32 dot data signals and 32 data clock signals are generated and sent to the shift register 7 because the data driver 9 in the data driver block 6 contains 32 output circuits. At the time, eight of the dot data signals are also sent to the driver 9 through eight output circuits 7*b* and the eight output circuits 8*b*, but are not used for operation of the display panel 13 because eight output circuits 9*b* are not connected to the data electrodes.

With the LCD device described above, the number of the output circuits of the data driver is greater than the number of the picture elements or dots per row required to display one character on the display panel, or the number of data electrodes, thus dot data signals and data clock signals for the extra data driver bits also needs to be generated.

Further, for example, to build a large-capacity LCD system for public display of a big screen, a display system must be made up of display units of size that can be manufactured for cascading them to provide the desired big screen from restrictions of outer dimensions of the units that can be manufactured. In this case, unified control of the drive circuits of the display units as one drive system is preferable to separate control of the units because the circuit configuration for the former is often simplified.

However, to use the display device shown in FIG. 1 as the display unit, extra operation of generating the dot data signals and data clock signals for the extra data driver bits is involved as described above, and if such signals cannot be generated, control circuits of different configurations must be provided for each display unit to control the drive circuits of the display units separately, thus the circuit configuration becomes complicated.

SUMMARY OF THE INVENTION

Accordingly, it is an object of the invention to provide a dynamic addressing display device which can operate without generating dot data signals or data clock signals for extra data driver bits when the number of the data driver bits is greater than the number of picture elements or dots per row on a display panel.

Another object of the invention is to provide a dynamic addressing display system which can easily control a number of display units by one control circuit.

According to a first aspect of the invention, there is provided a dynamic addressing display device, which comprises a display panel having a plurality of scanning electrodes and a plurality of data electrodes, a scanning shift register and a scanning driver for driving the scanning electrodes and a data shift register and a data driver for driving the data electrodes. The data shift register and the data driver each containing a greater number of bits than the number of bits required for driving the data electrodes.

The device has means for generating and adding clock signals corresponding to the number of extra bits of the data shift register to the clock signals corresponding to the number of the data electrodes.

Preferably, the clock signal adding means comprises a counter for counting the number of data clock signals sent to the data shift register, and a clock signal modulator responsive to a specific number of data clock signals counted by the counter for adding clock signals corresponding to the number of extra bits of the data shift register to clock signals corresponding to the number of the data electrodes to modulate the data clock signals and then for sending the resultant data clock signals modulated to the data shift register.

With the display device of the invention, clock signals corresponding in number to the number of the extra bits of the data shift register are added to every group of clock signals corresponding in number to the number of data electrodes of the display panel, and sends the resultant modulated clock signals to the data shift register, so that desired data is then output accurately from the data shift register to the data driver. Thus, even if the data driver contains a greater number of bits than the number of picture elements or dots per row, the display device can also operate without any hindrance.

According to a second aspect of the invention, there is provided a dynamic addressing display system, which comprises a plurality of the display devices of the first aspect as display units. The data shift registers of the units are cascaded to each other for sending display data from the first to last data shift registers in order. The data stored in the data shift registers is then sent to the latches of the display units separately in synchronization with a latch signal.

In the display system of the invention, if display data signals are sent from one place to the data shift registers, display data can be automatically distributed to the display units for easily controlling the display units by one control circuit.

DESCRIPTION OF THE PREFERRED EMBODIMENTS

Referring now to the accompanying drawings, preferred embodiments of the invention will be described below.

[First embodiment]

Figure 1:
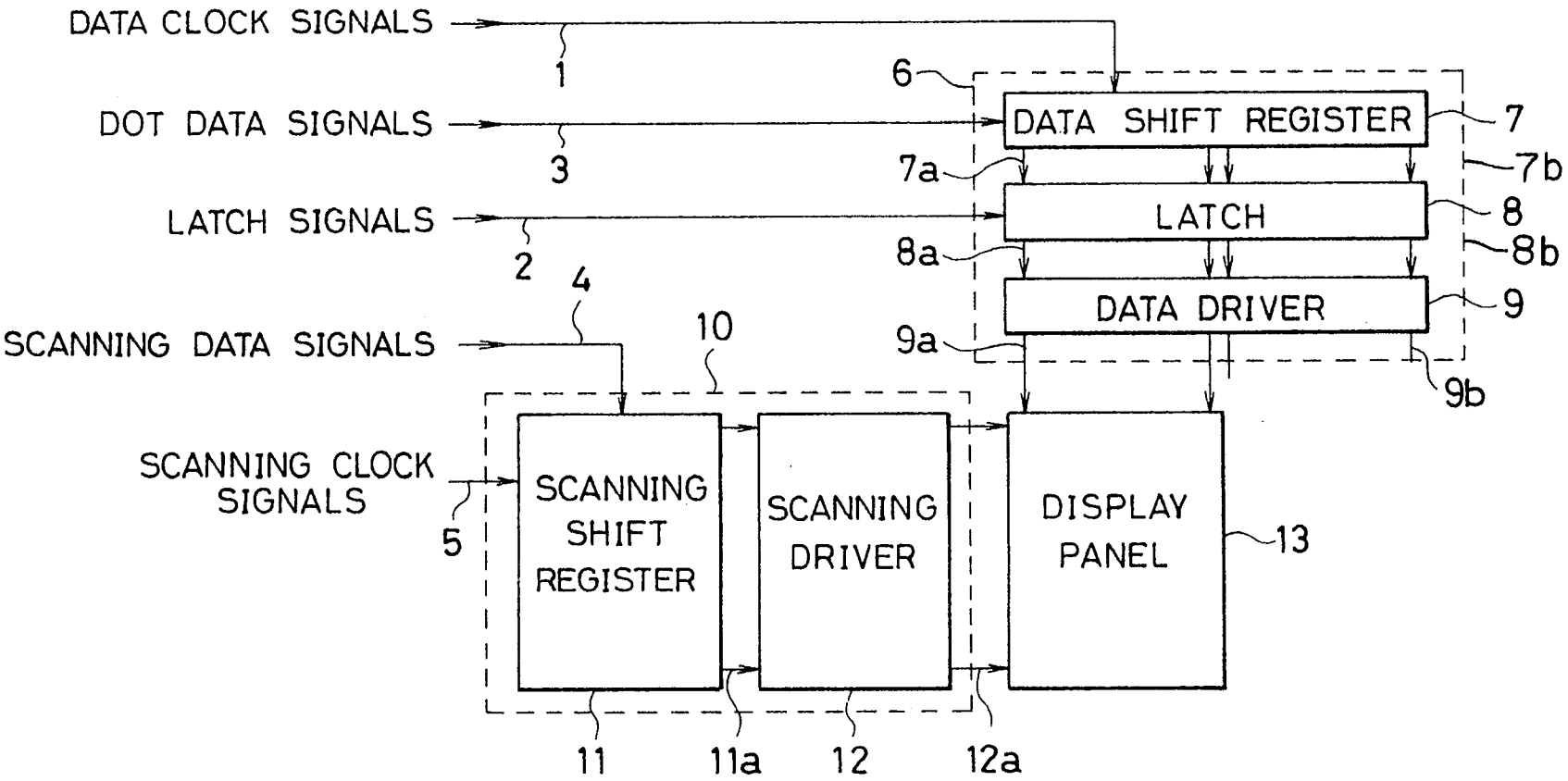
FIG. 1 is a circuit block diagram of an example of a conventional dynamic addressing LCD device.
Figure 2:
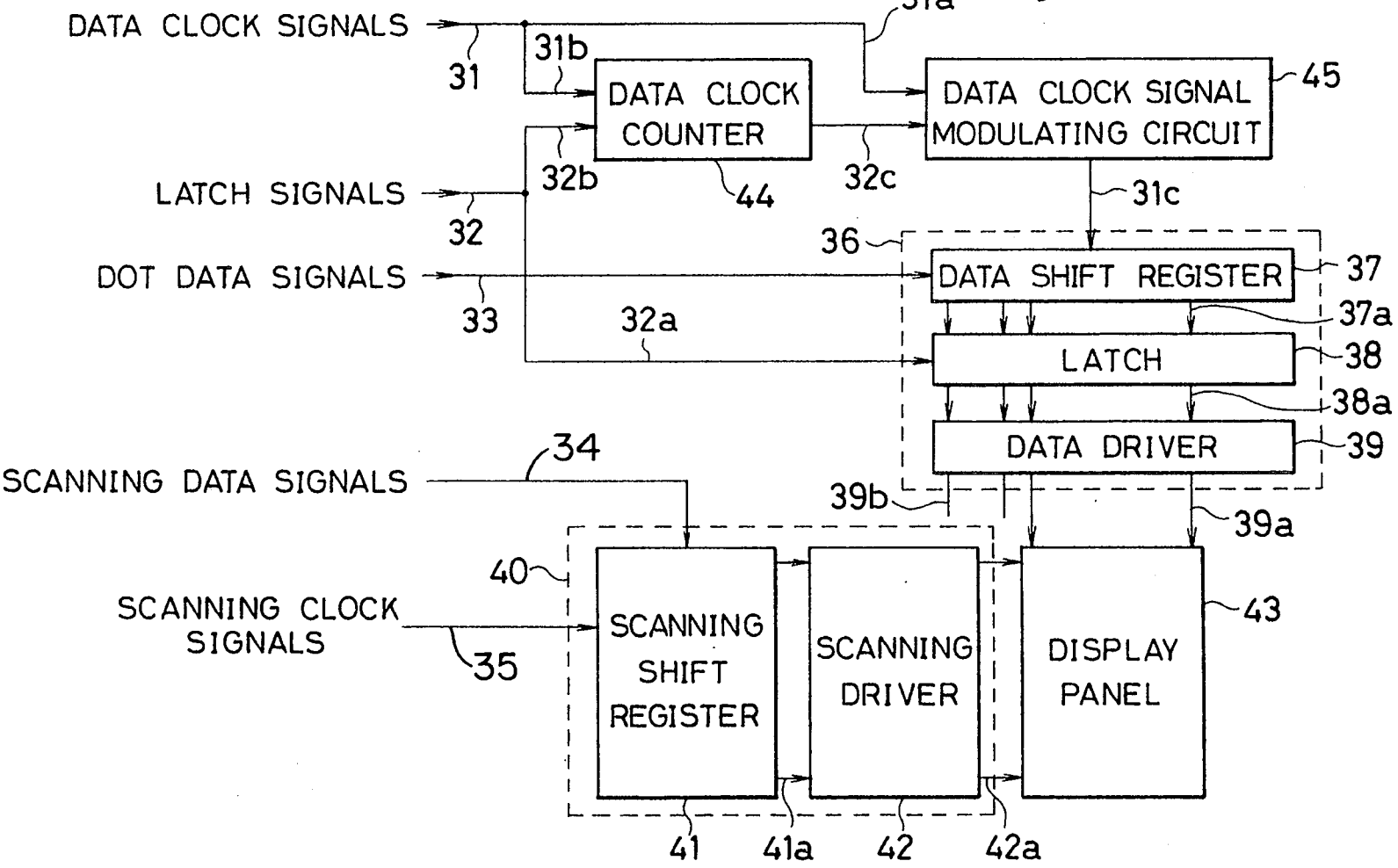
FIG. 2 is a circuit block diagram of a dynamic addressing display device according to a first embodiment of the invention.

FIG. 2 shows a block diagram of a dynamic addressing display device according to a first embodiment of the invention. This display device comprises a display panel 43 containing scan electrodes (not shown) and data electrodes (not shown) which are disposed like a matrix, a scanning driver block 40 for driving the scan electrodes, and a data driver block 36 for driving the data electrodes. The number of picture elements required to display one character on the display panel 43 is 24×24 (length×breadth), while a data driver 39 in the data driver block 36 has 32 bits, the number which is greater by eight than the number of picture elements or dots required per row to display one character on the panel 43. A scanning driver 42 in the scanning driver block 40 has 24 bits, the number which matches the number of picture elements or dots per row required to display one character on the panel 13.

The scanning driver block 40 comprises a shift register 41 and a driver 42; a scanning data signal and a scanning clock signal are fed on lines 34 and 35 respectively into the shift register 41. Each time 24 clock signals are fed into the shift register 41, the scanning data stored in the shift register 41 is sent to the driver 42 in parallel through 24 output circuits 41*a*. The driver 42 is responsive to the received scanning data for applying voltage in parallel through 24 output circuits 42*a* to turn on specific one of the scanning electrodes. Thus, the scan electrodes are scanned on a predetermined cycle.

The data driver block 36 comprises a shift register 37, a latch 38 and a driver 39. A line 31 on which a data clock signal is sent to the shift register 37 is branched into lines 31*a* and 31*b* on the way; the line 31*a* is connected to a data clock signal modulating circuit 45 and the line 31*b* to a data clock counter 44. Therefore, the data clock signal is inputted to the data clock counter 44 and the data clock signal modulating circuit 45 at the same time.

The counter 44 counts the number of the data clock signals sent to the shift register 37 and sends the result to the modulating circuit 45 through a line 32*c*.

In response to the data concerning the number of the data clock signals received from the counter, the data clock signal modulating circuit 45 modulates the data clock signals, and adds data clock signals equal in number to the number of extra bits of the data shift register (in this case, 8) to the data clock signals for each group of data clock signals equal to the number of data electrodes (in this case, 24). Then, the modulating circuit 45 sends the resultant data clock signals modulated to the shift register 37 through a line 31*c*.

A line 32 through which a latch signal is sent is branched into lines 32*a* and 32*b* on the way; the line 32*a* is connected to the latch 38 and the line 32*b* to the data clock counter 44. Therefore, the latch signal is input to the data clock counter 44 and the latch 38 at the same time.

A dot data signal is sent to the data shift register 37 through a line 33.

Next, the operation of the display device having the above configuration is described.

The numbers of the generated dot data signals and data clock signals are each 24 which equals the number of the picture elements or dots per row required to display one character on the display panel 43, namely, the number of data electrodes.

The data clock signals are fed into the data clock counter 44 and the data clock signal modulating circuit 45 through lines 31*b* and 31*a* respectively. The modulating circuit 45 outputs the data clock signals thus received to the data shift register 37 as they are, until the modulating circuit 44 receives a count signal from the counter 44. Meanwhile, in response to the data clock signals, dot data signals are fed through the line 33 into the shift register 37 for storage.

In synchronization with the first latch signal, the counter 44 starts counting the number of the data clock signals. When the count reaches 24, the counter 44 outputs a signal indicating the count to the modulating circuit 45 on the line 32*c*. In response to the count signal, the modulating circuit 45 generates and adds eight data clock signals to the end of the 24 data clock signals received so far thereby to modulate the input data clock signals. Then, the modulating circuit 45 sends the resultant data clock signals modulated to the data shift register 37.

At this time, 24 dot data signals have already been input to the data shift register 37 for storage in synchronization with the data clock signals. By the added 8 data clock signals, the dot data stored so far is forced to be shifted in sequence, thereby storing desired dot data corresponding to the 24 bits used for driving the data electrodes in the register 37.

Next, the second latch signal is sent to the data clock counter 44 and the latch 38. In synchronization with the latch signal, the dot data of 32 bits in the shift register 37 is sent to the latch 38 in parallel through 32 output circuits 37*a* in synchronization with scanning the scanning electrodes. Immediately, the dot data sent to the latch 38 is then sent to the driver 39 in parallel through 32 output circuits 38*a*. The driver 39 sends the dot data pieces of 24 bits received through the circuit 38*a* to the data electrodes in parallel through 24 output circuits 39*a* to drive the data electrodes, so that an information on the cycle is displayed on the display panel 43.

After this, the operation sequence is repeated to display desired information on the display panel 43.

The 8 output circuits 39*b* of the data driver 39 are not connected to the data electrodes, so that the remaining 8-dot data piece in the shift register 37 are not used for the operation of the display panel 43.

Thus, the display device of the invention can operate without generating the dot data signals or data clock signals for the extra 8 data driver bits.

With the display device, the data clock signals for the extra 8 data driver bits are generated and added by the data clock signal modulating circuit 45, but extra dot data signals corresponding to the data clock signals are not generated, thus dot data stored in extra bits of the data shift register 37 are not specified. It is assumed that the same data as the 24th dot data piece or the 25th, namely, the first dot data piece on the next cycle is stored. Since the dot data stored in the extra register portion are not used for display operation, no hindrance occurs even if they are not specified.

[Second embodiment]

Figure 3:
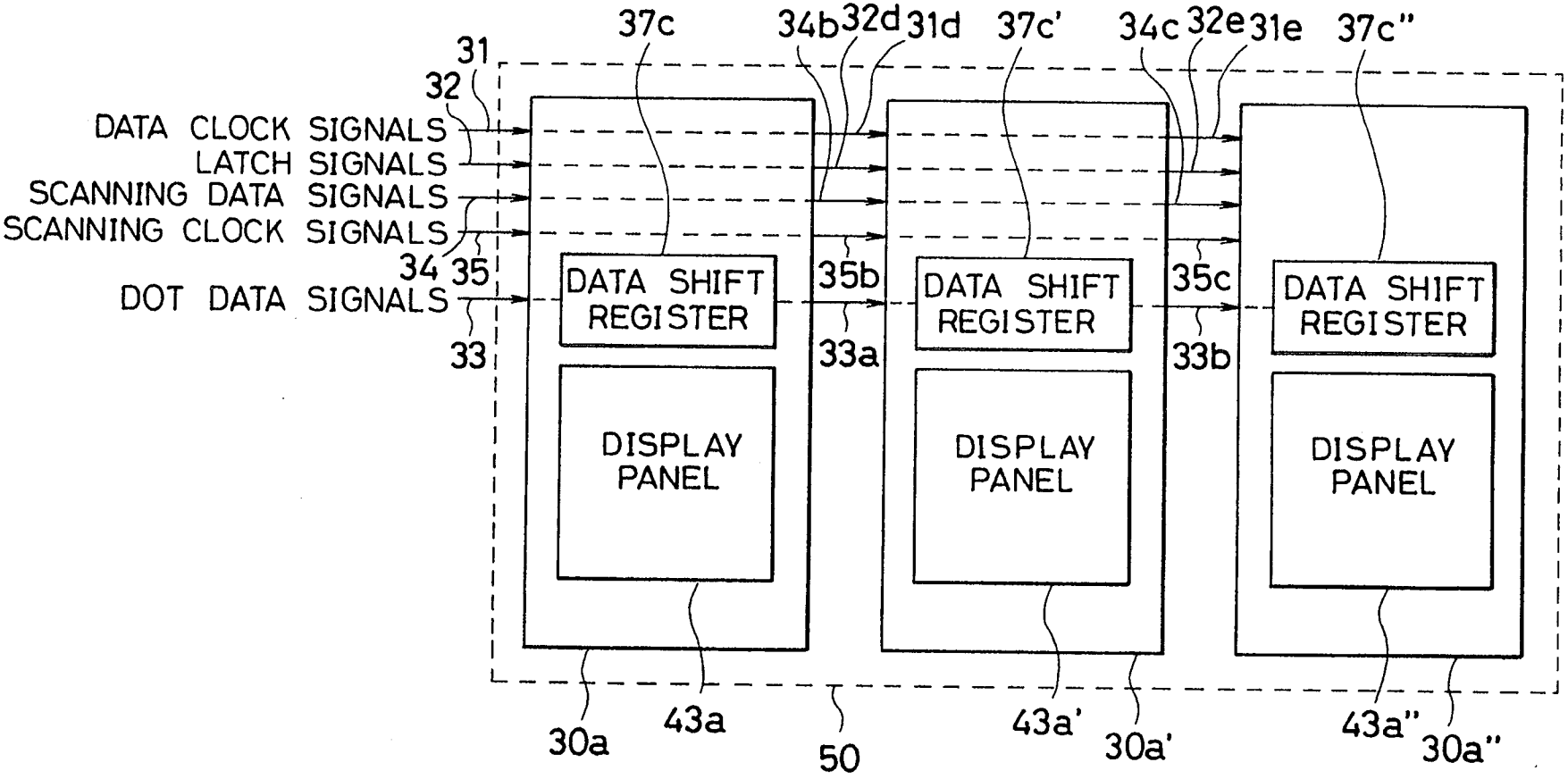
FIG. 3 is a circuit block diagram of a dynamic addressing display system according to a second embodiment of the invention.
Figure 4:
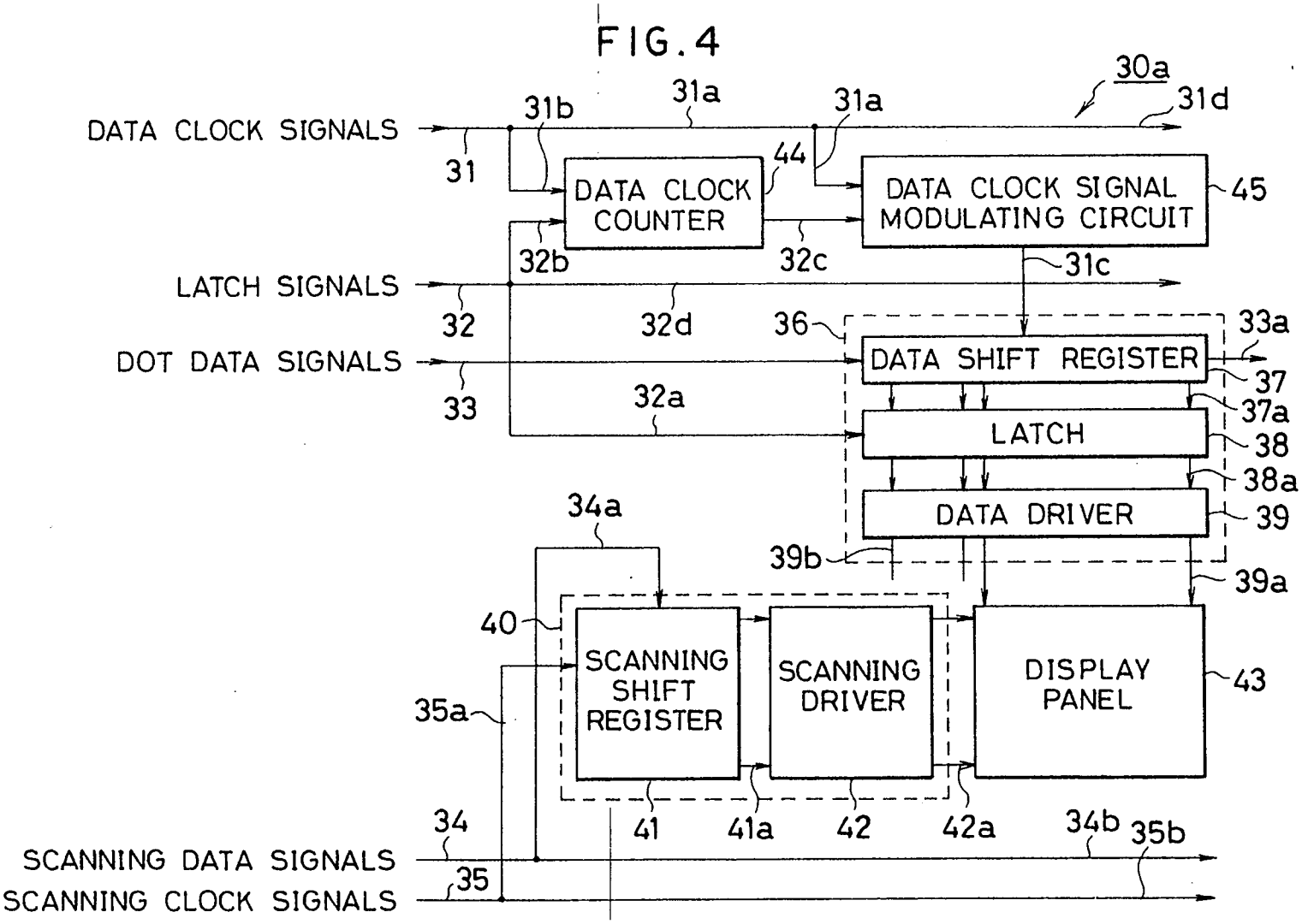
FIG. 4 is a circuit block diagram of a display unit used with the display system shown in FIG. 3.
Figure 5:
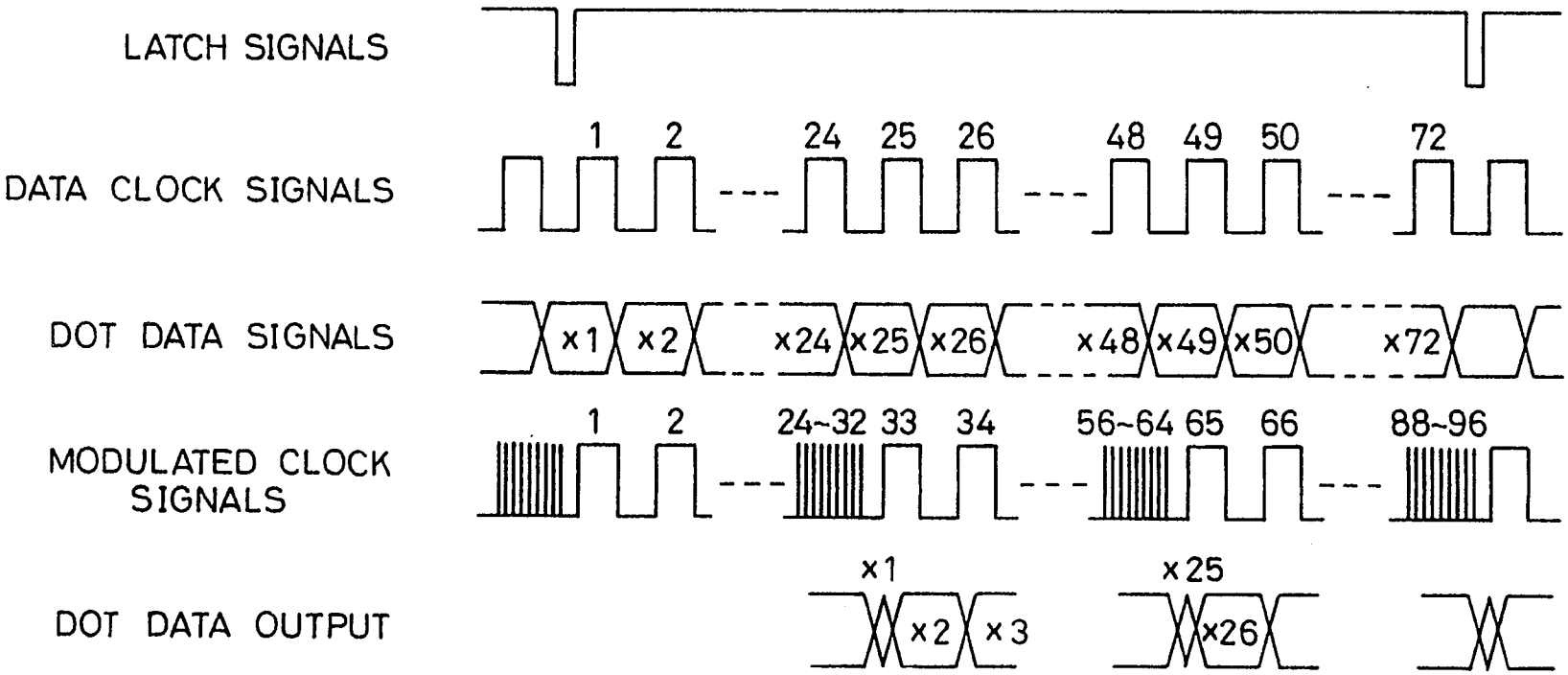
FIG. 5 is a timing chart of signals of the display system shown in FIG. 3.

FIGS. 3 to 5 show a dynamic addressing display system according to a second embodiment of the invention. As shown in FIG. 3, the display system 50 comprises a first display unit 30*a*, a second display unit 30*a'* and a third display unit 30*a''*. These units 30*a*, 30*a'* and 30*a''* are cascaded to each other, each of which is of the same configuration as the display device shown in FIG. 2. Each of display panels 43*a*, 43*a'* and 43*a''* of the display units, 30*a*, 30*a'* and 30*a''* is of a dot matrix type of 24×24 dots (length×breadth), thus the display panel of the display system 50 made up of the three display units is of a dot matrix type of 24×72 dots (length×breadth).

FIG. 4 shows the configuration of the first display unit 30*a*. The corresponding parts to those shown in FIG. 2 are designated by the same reference numerals in FIG. 4. A data clock signal sent to the display unit 30*a* through the line 31 is fed into the data clock signal modulating circuit 45 and a data clock counter 44 respectively through the lines 31*a* and 31*b*, and further is sent to the adjacent display unit 30*a'* through a line 31*d*.

The data clock signal sent to the display unit 30*a'* is fed into a data clock signal modulating circuit (not shown) and a data clock counter (not shown) of the display unit 30*a'* as in the display unit 30*a*, and further is sent to the adjacent display unit 30*a''* through a line 31*e*.

The data clock signal sent to the display unit 30*a''* is fed into a data clock signal modulating circuit (not shown) and a data clock counter (not shown) of the display unit 30*a''* as in the display unit 30*a* or 30*a'*.

A latch signal sent to the display unit 30*a* through a line 32 is fed into a latch 38 and the data clock counter 44 respectively through lines 32*a* and 32*b*, and further is sent to the adjacent display unit 30*a'* through a line 32*d*. The latch signal sent to the display unit 30*a'* is fed into a latch (not shown) and the data clock counter (not shown) of the display unit 30*a'* as in the display unit 30*a*, and further is sent to the adjacent display unit 30*a''* through a line 32*e*.

The latch signal sent to the display unit 30*a''* is fed into a latch (not shown) and the data clock counter (not shown) of the display unit 30*a''* as in the display unit 30*a* or 30*a'*.

A dot data signal sent to a data shift register 37*c* of the display unit 30*a* through a line 33 is sent to a data shift register 37*c'* of the adjacent display unit 30*a'* through a line 33*a*. Further, the dot data signal is sent to a data shift register 37*c''* of the adjacent display unit 30*a''* through a line 33*b*.

A scanning data signal sent to the display unit 30*a* through a line 34 is fed into a scanning shift register 41 through a line 34*a*, and is sent to a scanning shift register (not shown) of the adjacent display unit 30*a'* through a line 34*b*. Further, the scanning data signal is sent to a scanning shift register (not shown) of the adjacent display unit 30*a''* through a line 34*c*.

A scanning clock signal sent to the display unit 30*a* through a line 35 is fed into the scanning shift register 41 through a line 35*a*, and is sent to the scanning shift register (not shown) of the adjacent display unit 30*a'* through a line 35*b*. Further, the scanning clock signal is sent to the scanning shift register (not shown) of the adjacent display unit 30*a''* through a line 35*c*.

Thus, in the display system 50, the data clock signal, the latch signal, the scanning clock signal and the scanning data signal are inputted to the three display units 30*a*, 30*a*', and 30*a*'' in parallel; therefore, these units are synchronized with each other for operation. The dot data signal is inputted to the three display units in series; resultantly, the dot data inputted to the first display unit 30*a* is then sent to the second unit 30*a*', and then to the third unit 30*a*''. Each dot data inputted to the units is used to drive the display panels 43*a*, 43*a*', and 43*a*'' separately.

Next, the operation of the display system 50 having the configuration mentioned above is described.

In synchronization with a latch signal, each of the data clock counters of the display units 30*a*, 30*a*' and 30*a*'' starts counting the number of received data clock signals. When the count reaches 24, the data clock counter outputs a signal indicating the count to a data clock signal modulating circuit. In response to the count signal, the modulating circuit generates and adds 8 clock signals to the end of the 24 clock signals received so far, and sends them to the data shift registers 37*c*, 37*c*' and 37*c*'' of the display units 30*a*, 30*a*' and 30*a*''.

Then, the first to 24th dot data pieces stored so far in the data shift register 37*c* of the first display unit 30*a* are shifted; as a result, the 24 dot data pieces and the 8 dot data pieces added to them are inputted to the data shift register 37*c* of the first display unit 30*a*.

The operation sequence to this point is the same as with the display device shown in FIG. 2.

Next, when the count of the data clock counter reaches 48, the data clock signal modulating circuit generates and adds 8 clock signals to the end of the 24 clock signals, and sends them to the data shift registers 37*c*, 37*c*' and 37*c*'' of the display units 30*a*, 30*a*' and 30*a*''. Then, the 25th to 48th dot data pieces are shifted; as a result, the 24 dot data pieces and the 8 dot data pieces added to them are inputted from the data shift register 37*c* to the data shift register 37*c*' of the second display unit 30*a*'. The dot data outputted from the shift register 37*c* are shown at the bottom of FIG. 5.

When the count of the data clock counter reaches 72, the data clock signal modulating circuit generates and adds 8 clock signals to the end of the 24 clock signals, and sends them to the data shift registers of the display units 30*a*, 30*a*' and 30*a*''. Then, the 49th to 72nd dot data pieces are shifted; as a result, the 24 dot data pieces and the 8 dot data pieces added to them are inputted to the data shift register 37*c*'' of the third display unit 30*a*''.

When a new latch signal is input, the dot data pieces on a latch cycle stored in the data shift registers 37*c*, 37*c*' and 37*c*'' are sent to the latches of the display units 30*a*, 30*a*' and 30*a*'' and further to the data drivers all at once. Thus, the data electrodes of the display panels 43*a*, 43*a*' and 43*a*'' are driven based on the dot data stored in the data shift registers 37*c*, 37*c*' and 37*c*'' to display an information on the cycle on the display system panel made up of the three display panels.

The operation is repeated to display desired information on the display system panel.

As described above, in the display system of the invention, the data shift registers 37*c*, 37*c*' and 37*c*'' are cascaded and the data clock, dot data and latch signals are sent from one place to the shift registers, thereby automatically distributing dot data to the display units 30*a*, 30*a*' and 30*a*'' for easily controlling a number of display units by one control circuit.

Although both the embodiments are described as a LCD device and LCD system, other desired display panels can be used if they are driven dynamically like the LCD panels. As the counter and data clock signal modulating circuit, those of any desired configuration can be used if they function like the counter and modulator described above. The display panels are not limited to those of dot matrix type.

What is claimed is:

1. A dynamic addressing display device comprising:
   a display panel having a plurality of scanning electrodes and a plurality of data electrodes;
   scanning driver means coupled to said display panel for driving said plurality of scanning electrodes upon receipt of scanning data signals and scanning clock signals;
   data driver means coupled to said display panel for driving said plurality of data electrodes upon receipt of dot data signals and data clock signals, wherein each dot data signal and data clock signal is representative of a bit and a required number of bits are needed to drive said plurality of data electrodes, said data driver means containing at least one additional bit exceeding the required number of bits;
   a data clock counter for counting the data clock signals applied to said data driver means; and
   data clock adder means including means for receiving said data clock signals; and means for adding an additional clock signal to a set of data clock signals upon receipt of a count signal from said data clock counter indicating a count equal to the required number, said additional clock signal including a number of bits corresponding in number to the at least one additional bit, wherein said additional clock signal is not used for driving said plurality of data electrodes.

2. A dynamic addressing display device as claimed in claim 1, wherein said scanning driver means includes:
   a scanning shift register adapted for receiving said scanning data signals and scanning clock signals; and
   a scanning driver coupled between the scanning shift register and the display panel for driving the plurality of scanning electrodes based upon receipt of said scanning data signals and scanning clock signals from said scanning shift register.

3. The display device as claimed in claim 1, wherein said data clock adder means receives said data clock signal and said count signal from said data clock counter and then, modulates said data clock signal thus received to generate a modulated data clock signal in which said additional clock signal is added to every set of data clock signals.

4. A dynamic addressing display device as claimed in claim 3, wherein said data driver means includes:
   a data shift register coupled to receive said dot data signals and said modulated clock signals; and
   a data driver connected to said display panel for driving said plurality of data electrodes based upon receipt of said dot data signals from said data shift register.

5. A dynamic addressing display device as claimed in claim 4, wherein the data driver means further includes a latch coupled between the data shift register and data driver for synchronizing said dot data signals with said modulated clock signals upon receipt by the latch of a latch signal.

6. A dynamic addressing display system having a plurality of display units, wherein each of said plurality of display units comprises:

a display panel having a plurality of scanning electrodes and a plurality of data electrodes;

scanning driver means coupled to said display panel for driving said plurality of scanning electrodes upon receipt of scanning data signals and scanning clock signals;

data driver means coupled to said display panel for driving said plurality of data electrodes upon receipt of dot data signals and data clock signals, wherein each dot data signal and data clock signal is representative of a bit and a required number of bits are needed to drive said plurality of data electrodes, said data driver means containing at least one additional bit exceeding the required number of bits;

a data clock counter for counting the data clock signals applied to said data driver means; and data clock adder means including means for receiving said data clock signals; and means for adding an additional clock signal to a set of data clock signals upon receipt of a count signal from said data clock counter indicating a count equal to the required number, said additional clock signal including a number of bits corresponding in number to the at least one additional bit, wherein said additional clock signal is not used for driving said plurality of data electrodes and said data driver means of said plurality of display units are cascaded to each other for sending display data from a first data driver means to a last data driver means in order for storage and the data stored in said data driver means are sent to respective display units separately in synchronization with a latch signal.

7. A dynamic addressing display system as claimed in claim 6, wherein each of said scanning driver means includes:

a scanning shift register adapted for receiving said scanning data signals and scanning clock signals; and a scanning driver coupled between a respective scanning shift register and display panel for driving the plurality of scanning electrodes based upon receipt of said scanning data signals and scanning clock signals from said scanning shift register.

8. The display system as claimed in claim 6, wherein said data clock adder means receives said data clock signal and said count signal from said data clock counter and then, modulates said data clock signal thus received to generate a modulated data clock signal in which said additional clock signal is added to every set of data clock signals.

9. A dynamic addressing display system as claimed in claim 8, wherein each of said data driver means includes:

a data shift register coupled to receive said dot data signals and said modulated clock signals; and a data driver connected to a respective one of said display panels for driving said plurality of data electrodes based upon receipt of said dot data signals from said data shift register.

10. A dynamic addressing display system as claimed in claim 9, wherein each of said data driver means further includes a latch coupled between the data shift register and data driver for synchronizing said dot data signals with said modulated clock signals upon receipt by the latch of a latch signal.

11. A dynamic addressing display system as claimed in claim 9, wherein said data shift registers of each of said data driver means are cascaded together.

12. The display system as claimed in claim 3, wherein said data clock signal and said latch signal are supplied to said display units in synchronization with each other.

* * * * *